US005299372A

United States Patent [19]

Kelly et al.

[11] Patent Number: 5,299,372

[45] Date of Patent: Apr. 5, 1994

[54] PRESS FOR SMOOTHING CREASES ON TIES

[75] Inventors: Thomas Kelly, Dunlaoghaire; Andrew Bradley, Dublin, both of Ireland

[73] Assignee: Arrowhead T.P. Limited, Dublin, Ireland

[21] Appl. No.: 863,192

[22] Filed: Apr. 3, 1992

[30] Foreign Application Priority Data

Apr. 3, 1991 [IE] Ireland ..... 1092/91

[51] Int. Cl.[5] ..... D06F 71/28; A47G 25/72

[52] U.S. Cl. ..... 38/36; 38/71

[58] Field of Search ..... 38/17, 26, 36, 43, 70, 38/71, 75; 223/57, 65; 292/19, 80, 87, DIG. 38

[56] References Cited

U.S. PATENT DOCUMENTS

| | | | |
|---|---|---|---|
| 1,175,700 | 3/1916 | Brunstad | 38/70 |
| 1,221,886 | 4/1917 | Mathews | 38/71 X |
| 1,325,308 | 12/1919 | Riddle | 38/71 |
| 1,498,654 | 6/1924 | Hauptman | 38/71 |
| 1,576,542 | 3/1926 | Phillips | 38/71 |
| 1,657,647 | 1/1928 | Strub | 38/71 |
| 1,662,562 | 3/1928 | Brandt | 38/71 |
| 1,683,255 | 9/1928 | Mortenson et al. | 38/71 |
| 1,700,763 | 2/1929 | Hodges et al. | 38/71 X |
| 1,950,498 | 3/1934 | Lehnen et al. | 38/71 |
| 2,612,258 | 9/1952 | Baur | 38/71 X |
| 2,629,948 | 3/1953 | Bently | 38/71 |
| 3,068,598 | 12/1962 | Johnston | 38/71 |
| 4,344,646 | 8/1982 | Michel | 292/DIG. 38 X |
| 4,730,731 | 3/1988 | Allison | 292/87 X |

FOREIGN PATENT DOCUMENTS

| | | | |
|---|---|---|---|
| 2313491 | 12/1976 | France | 38/71 |
| 2-099098 | 4/1990 | Japan | 38/17 |
| 282231 | 12/1927 | United Kingdom . | |
| 346540 | 4/1931 | United Kingdom . | |
| 363070 | 12/1931 | United Kingdom . | |
| 658157 | 10/1951 | United Kingdom . | |
| 1063245 | 3/1967 | United Kingdom . | |
| 1233904 | 6/1971 | United Kingdom . | |
| 2195231 | 4/1988 | United Kingdom | 38/17 |

*Primary Examiner*—Clifford D. Crowder
*Assistant Examiner*—Ismael Izaguirre
*Attorney, Agent, or Firm*—Scully, Scott, Murphy & Presser

[57] ABSTRACT

A tie press (1) having a base moulding (3), a heating element (4) covered by a foam pad (5) and a center moulding (6) having a tie receiving recess. A cover (7) is also provided having a foam pad insert (9) and is hingedly connected to the center and base mouldings (3,6). The press being designed to press creased front and rear knot forming sections ($K_F$,$K_R$) of a tie (2). The creased tie portions or portion is placed between the pads and the cover is lowered and locked on the mouldings by a locking and releasing device (36).

16 Claims, 5 Drawing Sheets 7
17
20
36
36

7
30
30
9
13
KR
C
KF
A 2
36
KF
KR
36

2

PRESS FOR SMOOTHING CREASES ON TIES

FIELD OF THE INVENTION

The invention relates to a press, particularly for pressing neckties.

SUMMARY OF THE INVENTION

According to the invention there is provided a tie-press for removing creases from at least a portion of a tie comprising a tie receiving member for receiving at least portion of a tie and a tie pressing member which is moveable relative to the tie receiving member from an open position for insertion and removal of a tie to a pressing closed position in which a tie is pressed between the members.

In one embodiment of the invention the tie receiving member and/or the tie pressing member is provided with a recess to receive at least a portion of a tie. Preferably the recess is shaped to conform to the general outline of at least a portion of a tie. In one case the recess is defined between a pair of spaced-apart side walls, the side walls being inclined in a longitudinal direction to substantially follow the shape of a tie. Typically the recess is provided in the tie receiving member. The recess may be of arcuate shape in longitudinal cross-section.

In one embodiment of the invention the tie is of the type comprising a front portion, a rear portion, and an intermediate neck surrounding portion between the front and rear portions, the front portion having a front knot forming section adjacent to the neck surrounding portion and the rear portion having a rear knot forming portion adjacent to the neck surrounding portion, and the recess is shaped to receive the front and/or rear knot forming portions.

In a preferred embodiment of the invention the tie pressing member is hingedly mounted to the tie receiving member for pivotal movement between the open and closed positions. Preferably the tie pressing member is hingedly mounted about a transverse hinge axis.

In another embodiment of the invention biasing means are provided for biasing the tie pressing member into a normally open position. Typically the biasing means comprises a spring such as a hair-type spring.

In one embodiment of the invention the tie pressing member comprises a cover and a tie-engaging resilient mat mounted to the cover. Typically the resilient mat comprises a pad of foam material.

In another embodiment of the invention the tie press includes closure means for retaining the tie pressing member in the closed position in pressing engagement with the tie receiving member. Preferably the closure means comprises co-operating engagement means on the cover and tie receiving member, and release means are provided for releasing the engagement means. Typically the co-operating engagement means comprises a projection on one of the tie pressing member or tie receiving member for engagement in a recess and the other of the tie receiving member or tie pressing member, the projection being releasably mounted in the recess on closure of the tie press. Preferably the release means comprise a spring release member and the recess is provided by an undercut in the spring release member which is moveable by an actuating means form a clamping position engaged with the projection to a release position allowing the tie pressing member to move to the open position. The actuating means and spring release means may be integral.

In one embodiment of the invention a projection and recess are provided at both sides of the tie receiving recess.

In one case the tie receiving member is mounted in a base support member. Preferably the tie pressing member includes a pair of sidewardly projecting stub axles which are held within recesses defined between the base support member and the tie pressing member.

In a preferred embodiment of the invention the tie press includes a heating means such as an electrical resistance heating element. Preferably control means such as a thermostat and/or time control means are provided for the heating means. Typically the heating means is associated with the tie receiving member. Preferably the heating means is provided below the tie receiving recess and is covered by a protective cover means. In one case the protective cover means comprises a heat resistant pad which may be of a foam material.

In a further embodiment of the invention stand-off means are provided to allow a tie to pass over the rear of the tie receiving member.

DETAILED DESCRIPTION OF THE INVENTION

Figure 1:
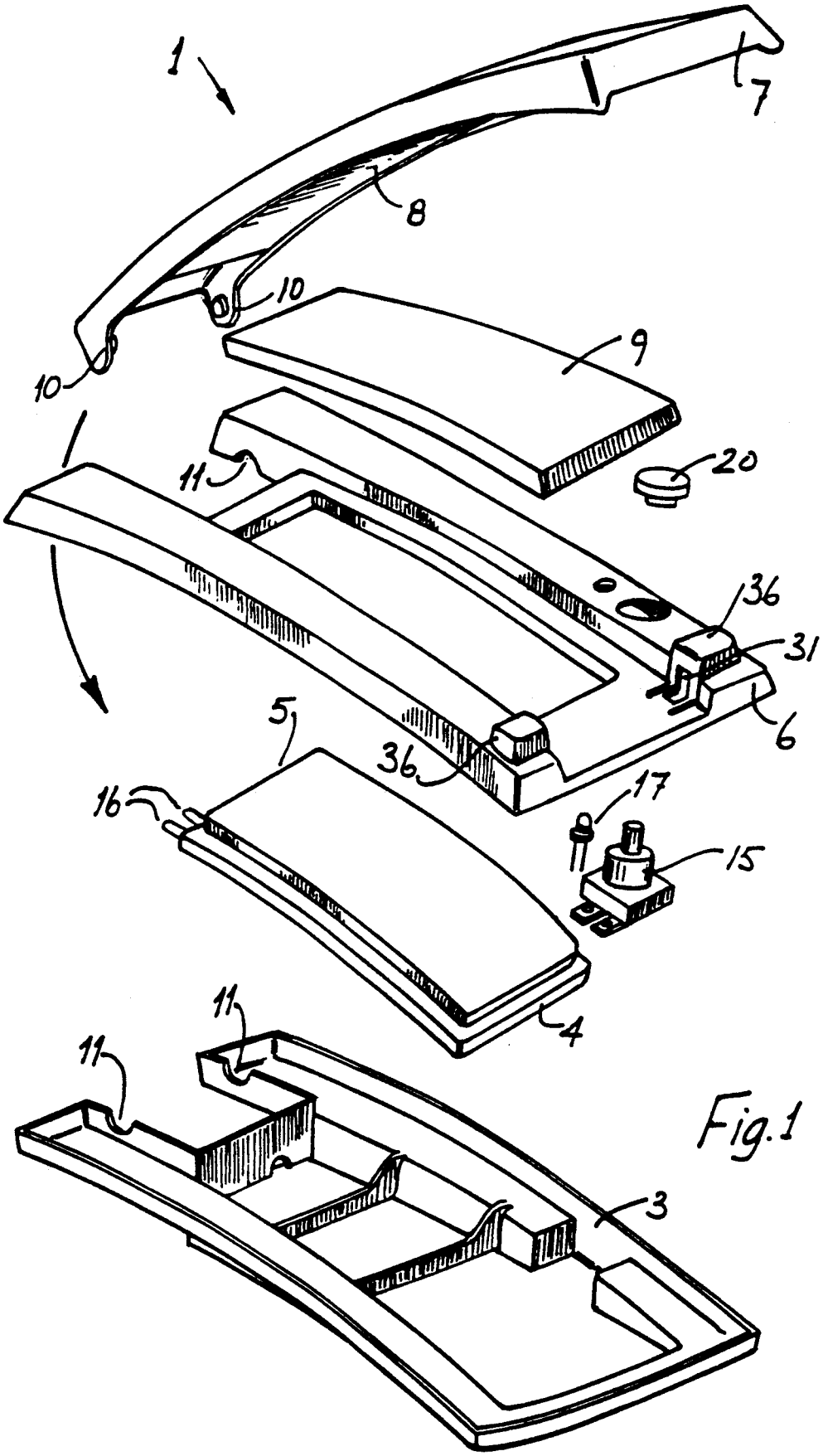
FIG. 1 is an exploded perspective view of a tie press according to the invention.
Figures 2, 3:
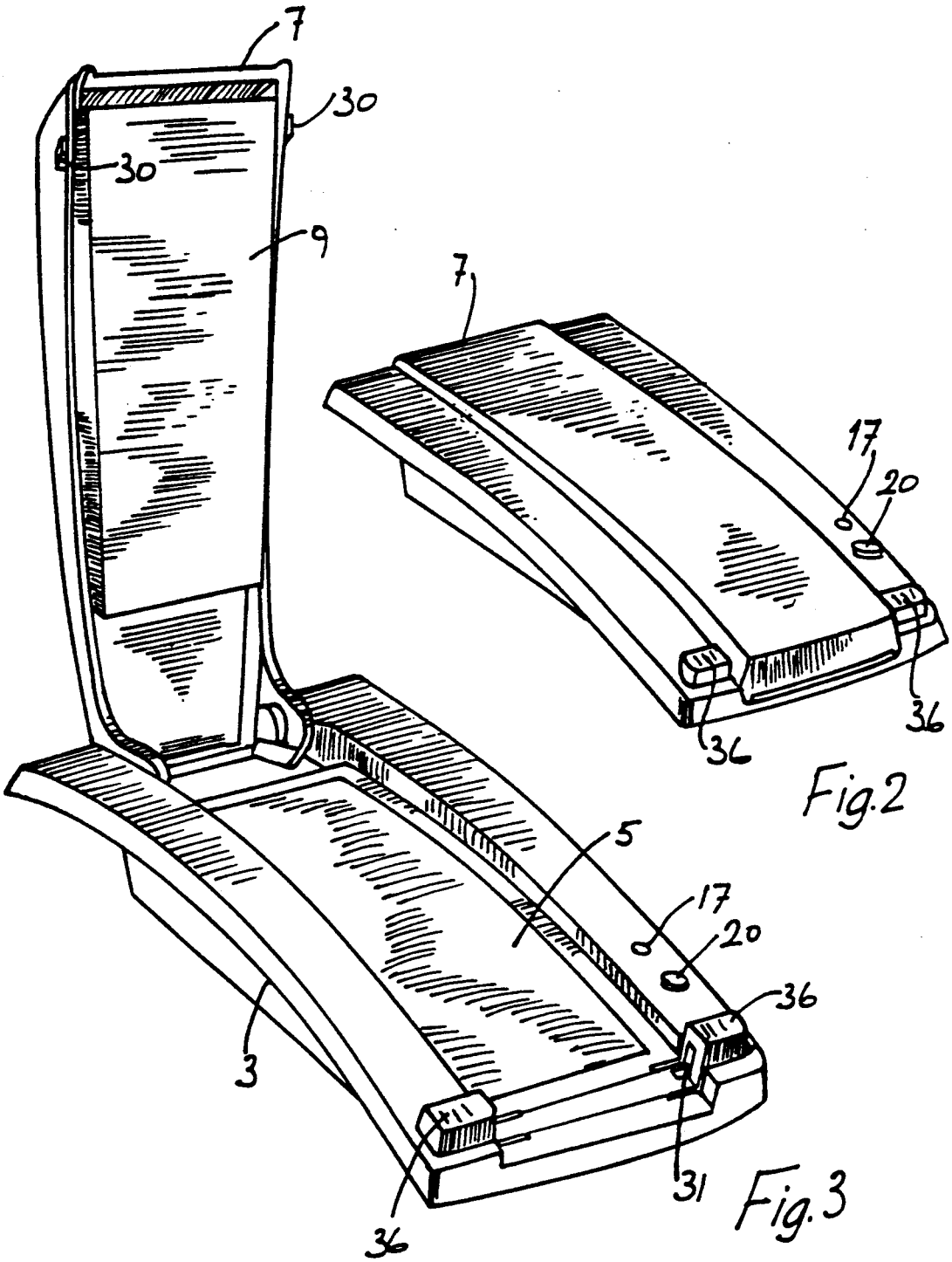
FIG. 2 is a perspective view of the tie press in an closed position.
FIG. 3 is a perspective view of the tie press in an open position.

Referring to the drawings there is illustrated a tie press according to the invention indicated generally by the reference numeral 1 for removing creases from at least a portion of a tie 2.

Figures 4, 5, 6:
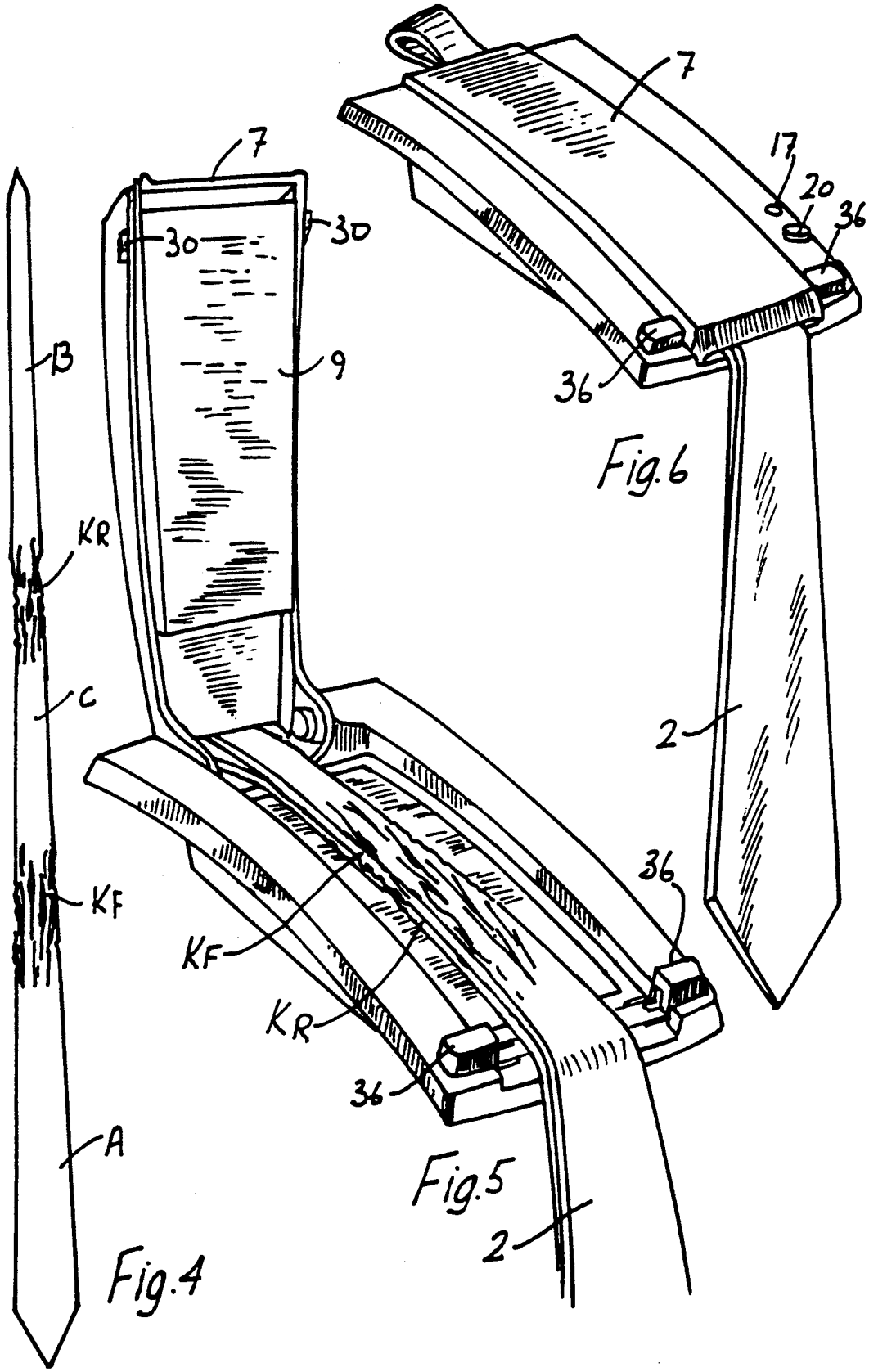
FIG. 4 is a diagrammatic view of a typical tie used with the tie press.
FIGS. 5 and 6 are perspective views of the tie press respectively open and closed with a tie in position.

Referring particularly to FIG. 4 a typical tie 2 comprises a front portion A, a rear portion B and an intermediate neck surrounding portion C between the front and rear portions A, B. The front portion A has a knot forming section $K_F$ and the rear portion B has a knot forming section $K_R$ which becomes creased, in use, because of the knot. The creasing is illustrated by wavey lines in FIG. 4.

The tie press 1 comprises a tie receiving member formed by a base moulding 3, a heating element 4 covered by a resilient mat such as a foam pad 5 and a center moulding 6 which is assembled onto the base moulding 3 and sandwiches the heating element and foam pad 5 in position therebetween. The tie press also includes a pressing member which in this case is provided by a cover 7 having a foam filler insert 8 covered by a resilient mat in the form of a foam layer 9. The cover 7 includes sidewardly projecting hinge pins 10 which are engageable in complementary recesses 11 in the center moulding 6 and base moulding 3 for hingedly mounting the cover 7 to the tie receiving member.

The heating element 4 is preferably an electrical resistance heating element, the operation of which is controlled by an on-off button or switch 15. Power supply to the heating element 4 is through pins 16 which are connected to a power supply in the form of an on-board battery supply or to a mains supply by an electric cable. A light emitting diode 17 is provided to indicate when the heating element 4 has been switched on. Control means may be provided for the heating element and the control means may be either a thermostatic control and/or a time control means. A cap 20 is provided for the button 15 for ease of operation and to improve the aesthetic appearance of the press when closed.

Closure means for retaining the cover 7 in pressing engagement with the tie receiving member is in this case provided by cooperating engagement means on the cover 7 and center moulding 6. In this case there are two sets of co-operating means one on either side of the cover 7 and each comprising as will be particularly apparent from FIGS. 9 and 10 a wedge shaped projection 30 extending sidewardly of the cover 7 and engageable in a complementary shaped recess 31 provided by an undercut in a spring member 35 which is movable by an actuating button 36 from a clamping position in which the undercut 31 is engaged with the wedge shaped projection 30 to a released position in which the projection is released from the undercut 31 allowing the cover 7 to be opened for insertion and removal of a tie. Preferably the spring member 35 and button 36 are integral members and are formed as part of the central moulding 6.

To accommodate the shape of at least portion of a tie 2 it will be noted that the side walls of the tie receiving recess of the center moulding 6 diverge outwardly from the inner end to conform to the general outline shape of that portion of the tie 2 including the front and rear knot forming sections $K_R$, $K_F$ respectively as will be particularly apparent from FIG. 5.

Figures 7, 8:
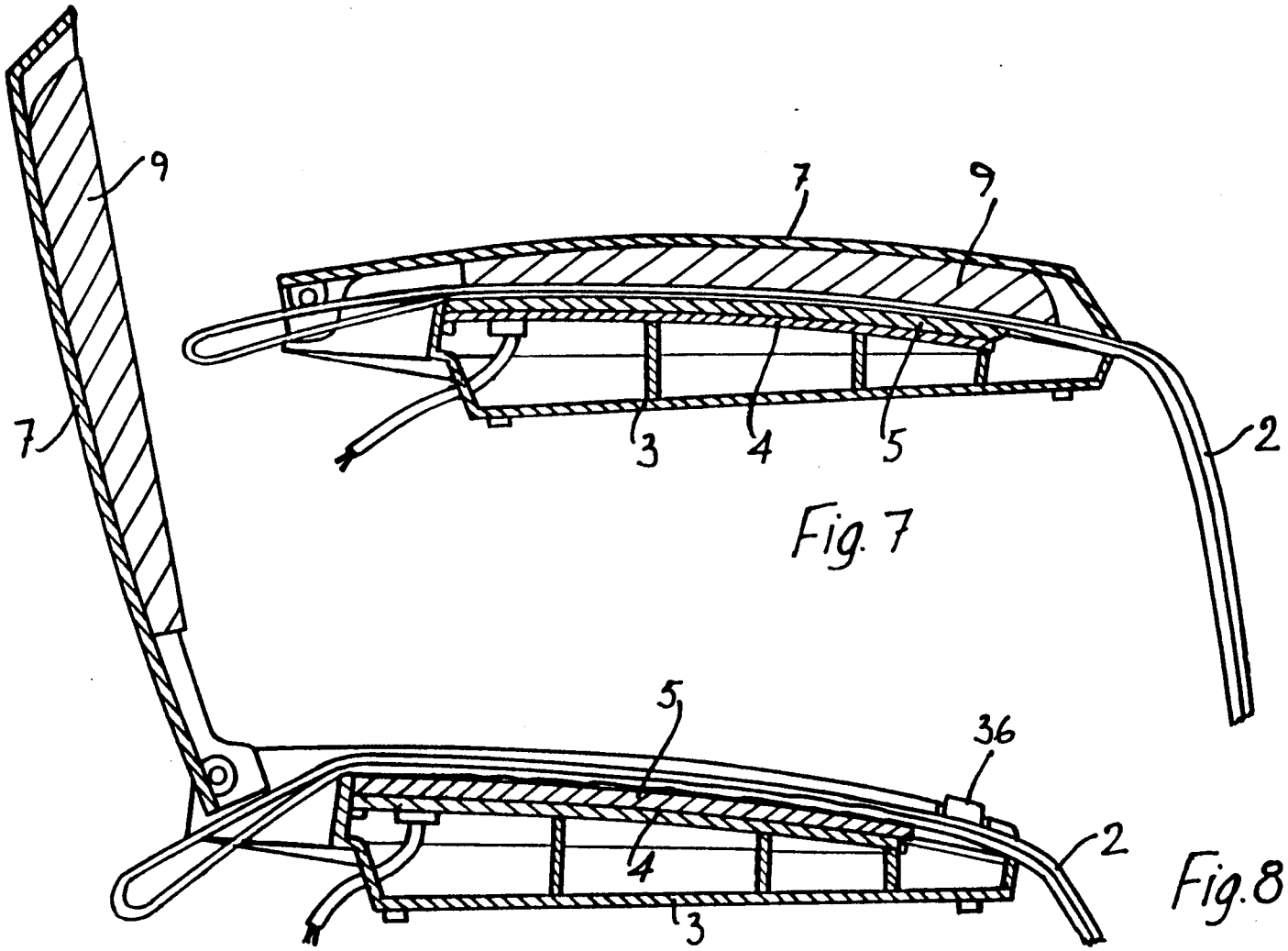
FIGS. 7 and 8 are longitudinal cross-sectional views of the tie press in the open and closed positions, respectively.
Figure 9:
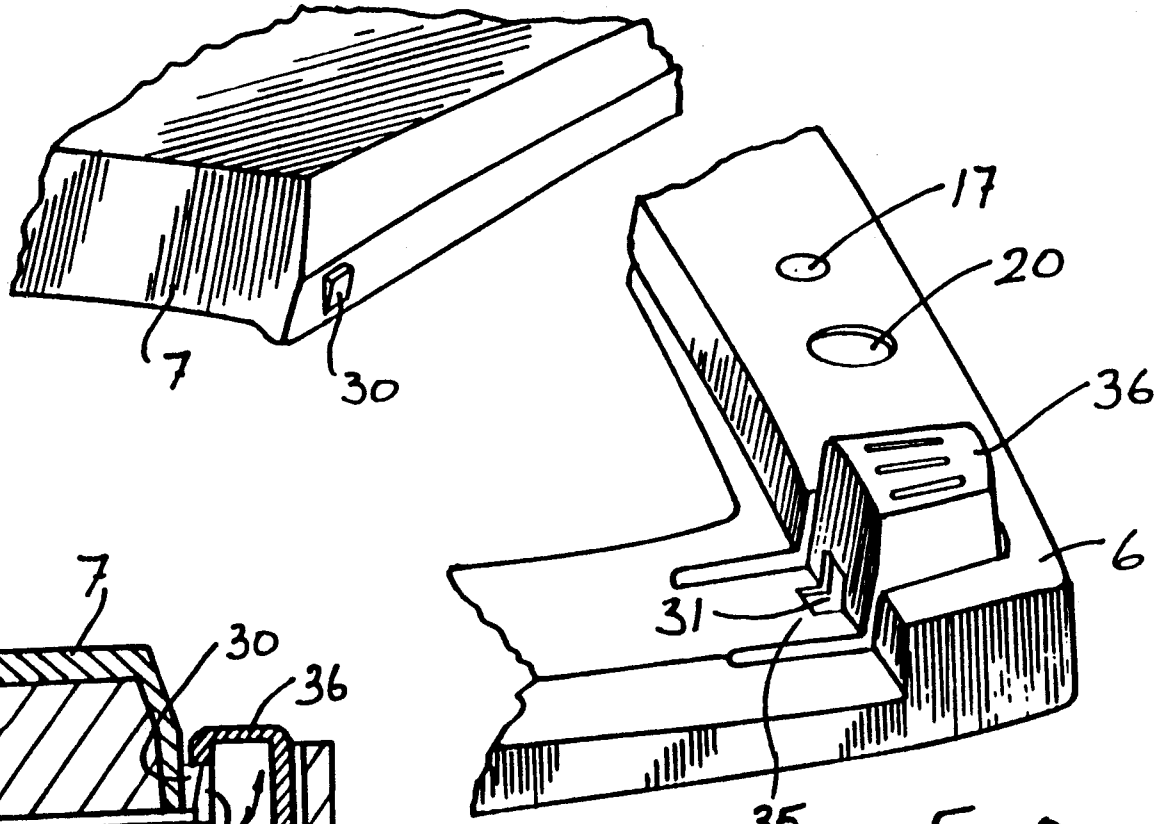
FIG. 9 is a perspective view of a detail of the tie press with the press open.
Figure 10:
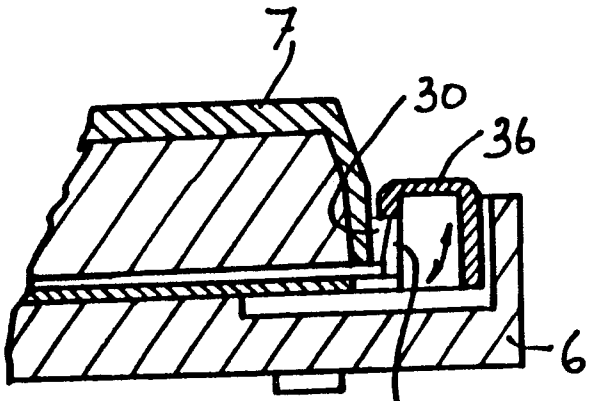
FIG. 10 is a cross-sectional view of the detail of FIG. 9 with the press closed.

In use, the cover 7 is first opened from the closed position shown in FIGS. 2, 6, 7 and 10 by pressing downwardly on the buttons 36 releasing the projections 30 from the undercuts 31 and allowing the cover 7 to be raised into the open position illustrated in FIGS. 5, 8 and 9. In this open position, a tie 2 is folded over and positioned in the tie receiving recess defined by the center moulding 6 so that at least the front and rear knot forming portions $K_F$, $K_R$ are located in the press. The cover 7 is then closed, the projections 30 engaging in the recesses 31 on closure of the cover 7 to clampingly engage the tie 2 between the pressing member defined by the cover 7 and the tie receiving member. The button 15 is the pressed to operate the heating element 4 to press the critical creased area of the tie. After a pre-set time, and/or after a pre-set temperature has been reached the heating element is turned off either automatically or manually and the tie with creases pressed out may be removed by opening the cover 7.

It will be appreciated that the base 3, cover 7, and rear hinge arrangement form a stand-off which facilitates feeding of a tie from the rear hinge area. The stand-off is provided to allow the tie to pass over the rear of the tie receiving member. In this case, the tie press has legs which define a slot, and this embodiment is used if it is desired to press only one creased area of the tie.

Many variations on the specific embodiment of the invention described will be readily apparent and accordingly the invention is not limited to the embodiments hereinbefore described which may be varied in both construction and detail.

We claim:

1. A tie press for pressing and removing creases from at least a portion of a tie, comprising:

a tie receiving member for receiving said portion of the tie;

a tie pressing member comprising a cover and a tie-engaging resilient mat mounted on the cover, said tie pressing member being movable relative to the tie receiving member from an open position for insertion and removal of the tie to a pressing closed position wherein the tie is pressed between the members; and closure means for retaining the tie pressing member in the closed position in pressing engagement with the tie receiving member;

the closure means being mounted on the cover and the receiving member and including i) cooperating engagement means for a releasably holding the tie pressing member in the closed position, and comprising a projection on at least one of the members for engagement in a recess in at least one of the member, the projection being releasably engaged in the recess on closure of the tie press, and ii) release means for releasing the tie pressing member form the closed position, and comprising a spring release member, said spring release member being movable by an actuating means from a clamping position in which the recess is engaged with the projection to a release position for moving the tie pressing member to the open position;

wherein at least one of said members includes a receiving recess to receive said portion of the tie, and said receiving recess is defined between a pair of spaced-apart side walls, the side walls being inclined in a longitudinal direction to substantially follow the shape of the tie.

2. The tie press as claimed in claim 1, wherein the tie pressing member is hingedly mounted to the tie receiving member for pivotal movement between the open and closed positions.

3. The tie press as claimed in claim 2, wherein the tie pressing member is hingedly mounted about a transverse hinge axis relative to a longitudinal direction of the press.

4. A tie press as claimed in claim 1 wherein the recess is provided by an undercut in the release member.

5. A tie press for pressing and removing creases from at least a portion of a tie, comprising:

a tie receiving member for receiving said portion of the tie;

a tie pressing member comprising a cover and a tie-engaging resilient mat mounted on the cover, said tie pressing member being movable relative to the tie receiving member from an open position for insertion and removal of the tie to a pressing closed position wherein the tie is pressed between the members;

the tie receiving member being mounted in a base support member; and the tie pressing member and the tie receiving member being jointed by a hinging arrangement including a pair of projecting stubaxles extending sidewardly of one of said pressing member and receiving member and a pair of recesses defined by the other of said pressing member and said receiving member and which stubaxles are engageable in said recesses;

wherein at least one of said members includes a receiving recess to receive said portion of the tie, and said receiving recess is defined between a pair of spaced-apart side walls, the side walls being inclined in a longitudinal direction to substantially follow the shape of the tie.

6. A tie press as claimed in claim 5 wherein the stubaxles project from the pressing member and the recesses are defined by the tie receiving member.

7. The tie press as claimed in claims 1 or 2, wherein the recess is shaped so as to conform to a general outline of said portion of the tie.

8. The tie press as claimed in claims 1 or 5, wherein the recess is provided in the tie receiving member.

9. The tie press as claimed in claims 1 or 5, wherein the tie consists of a front portion, a rear portion, and an intermediate neck surrounding portion between the front and rear portions, the front portion having a front knot forming section adjacent to the neck surrounding portion and the rear portion having a rear knot forming portion adjacent to the neck surrounding portion, and the recess is shaped so as to receive the front and/or rear knot forming portions.

10. The tie press as claimed in claims 1 or 5, wherein biasing means are provided for biasing the tie pressing member into said open position.

11. The tie press as claimed in claim 10 wherein the biasing means comprises a spring.

12. The tie press as claimed in claims 1 or 5, wherein the tie press includes a heating means and control means for controlling the heating means.

13. The tie press as claimed in claim 12 wherein the heating means is provided below the member receiving recess member.

14. The tie press as claimed in claims 1 or 5, wherein the tie receiving member includes a rear, and stand-off means are provided to allow the tie to pass over the rear of the tie receiving member.

15. A tie press for pressing and removing creases from at least a portion of a tie, comprising:

a tie receiving member for receiving said portion of the tie;

a tie pressing member comprising a cover and a tie-engaging resilient mat mounted on the cover, said tie pressing member being movable relative to the tie receiving member from an open position for insertion and removal of the tie to a pressing closed position wherein the tie is pressed between the members; and closure means for retaining the tie pressing member in the closed position in pressing engagement with the tie receiving member;

the closure means being mounted on the cover and the receiving member and including i) cooperating engagement means for releasably holding the tie pressing member in the closed position, and comprising a projection on at least one of the members for engagement in a recess in at least one of the members, the projection being releasably engaged in the recess on closure of the tie press, and ii) release means for releasing the tie pressing member from the closed position, and comprising a spring release member, said spring release member being movable by an actuating means from a clamping position in which the recess is engaged with the projection to a release position for moving the tie pressing member to the open position;

wherein at least one of said members includes a receiving recess to receive said portion of the tie, and the receiving recess is of arcuate shape in a longitudinal cross-section of the press.

16. A tie press for pressing and removing creases from at least a portion of a tie, comprising:

a tie receiving member for receiving said portion of the tie;

a tie pressing member comprising a cover and a tie-engaging resilient mat mounted on the cover, said tie pressing member being movable relative to the tie receiving member from an open position for insertion and removal of the tie to a pressing closed position wherein the tie is pressed between the members;

the tie receiving member being mounted in a base support member; and the tie pressing member and the tie receiving member being joined by a hinging arrangement including a pair of projecting stubaxles extending sidewardly of one of said pressing member and receiving member and a pair of recesses defined by the other of said pressing member and said receiving member and which stubaxles are engageable in said recesses;

wherein at least one of said members includes a receiving recess to receive said portion of the tie, and the receiving recess is of arcuate shape in a longitudinal cross-section of the press.

* * * * *

UNITED STATES PATENT AND TRADEMARK OFFICE

CERTIFICATE OF CORRECTION

PATENT NO. : 5,299,372

DATED : April 5, 1994

INVENTOR(S) : Thomas Kelly, et al.

It is certified that error appears in the above-indentified patent and that said Letters Patent is hereby corrected as shown below:

Column 1, line 13: after "least" insert --a--

Column 1, line 66: "form" should read --from--

Column 3, line 40: "$K_F$respectively" should read --$K_F$ respectively--

Column 4, line 31, Claim 1: "form" should read --from--

Column 5, line 38, Claim 13: "member" should read --tie--

Column 5, line 39, delete "member".

Signed and Sealed this

Twenty-seventh Day of September, 1994

*Attest:*

*Attesting Officer*

Bruce Lehman

BRUCE LEHMAN

*Commissioner of Patents and Trademarks*